United States Patent [19]

Kammeraad

[11] Patent Number: 4,768,479

[45] Date of Patent: Sep. 6, 1988

[54] OIL-SEALING VALVE GUIDE INSERT AND METHOD OF MANUFACTURE

[75] Inventor: James A. Kammeraad, Holland, Mich.

[73] Assignee: K-Line Industries, Inc., Holland, Mich.

[21] Appl. No.: 18,702

[22] Filed: Feb. 25, 1987

[51] Int. Cl.[4] ..... F01L 3/00

[52] U.S. Cl. ..... 123/188 GC; 384/292; 29/156.7 R; 29/402.08

[58] Field of Search ..... 123/188 GC, 188 P; 384/13, 14, 28, 291, 292, 286; 29/156.4 WL, 157.1 R, 156.7 R, 402.08, 402.09

[56] References Cited

U.S. PATENT DOCUMENTS

| | | | |
|---|---|---|---|
| 314,079 | 3/1885 | Thayer et al. | 384/162 |
| 1,132,758 | 3/1915 | Bache | 384/292 |
| 2,303,145 | 11/1942 | Taylor | 123/188 GC |
| 3,153,990 | 10/1964 | Kunzog | 92/169 |
| 3,265,052 | 8/1966 | Goloff | 123/188 GC |
| 3,581,728 | 6/1971 | Abraham | 123/188 GC |
| 3,828,415 | 8/1974 | Kammeraad et al. | 123/188 GC |
| 3,828,756 | 8/1974 | Kammeraad et al. | 123/188 GC |
| 4,103,662 | 8/1978 | Kammeraad | 123/188 GC |

FOREIGN PATENT DOCUMENTS

| | | |
|---|---|---|
| 582438 | 9/1958 | Italy . |
| 869384 | 5/1961 | United Kingdom . |

*Primary Examiner*—Samuel Scott
*Assistant Examiner*—Noah Kamen
*Attorney, Agent, or Firm*—Price, Heneveld, Cooper, DeWitt & Litton

[57] ABSTRACT

A slitted tubular valve guide is provided with a substantially spiral groove along its entire length. At each point of intersection between the spiral groove and the slit, the ends of the groove segments immediately adjacent the slit are offset by an amount sufficient to create a discontinuity in the groove. The spiral groove is, therefore, divided into a number of inclined, decoupled groove segments incapable of flowing lubricating oil along their linear extent to the combustion chamber. The tubular valve guide is rolled from flat stock having inclined parallel groove segments preformed in the surface.

20 Claims, 1 Drawing Sheet

OIL-SEALING VALVE GUIDE INSERT AND METHOD OF MANUFACTURE

BACKGROUND OF THE INVENTION

This invention relates to inserts for lining valve guides of an internal combustion engine and in particular to an insert, and method of manufacture thereof, having improved means to lubricate the valve stem.

Valve guides in an internal combustion engine can become worn through extended use. This is especially true when the valve guide is manufactured from cast iron or other nondurable material. Techniques have been disclosed for reaming the worn guide and inserting a tubular member into the reamed guide to refurbish it.

One such technique is disclosed in U.S. Pat. No. 3,828,756, issued to James Kammeraad and assigned to the assignee of the present invention. A slitted tubular member, rolled from a flat sheet of phosphor bronze, is press-fitted into a reamed valve guide. The tubular member is properly sized so that the slit will be substantially closed when the insert is fitted to the guide. A knurling tool is then forced down the insert to deform the metal to further seal the slit and to form spiral grooves in the surface of the guide liner contacting the valve stem. The spiral grooves provide a path for supplying lubricating oil to the surface of the reciprocating valve stem. The use of such Knurled phosphor bronze guide liners has been so successful that they are additionally being installed in production engines at the factory to increase the reliability and durability of the valve guides.

A problem that has been associated with the use of valve guide liners is oil migration along the valve stem. Lubricating oil is provided to the valve cam, cam follower and valve stem. As previously mentioned, the spiral grooves in the guide liner ensure proper movement of this oil to the surface of the valve stem reciprocating within the guide. Even when the spiral grooves are properly sized and the fit between the valve and guide is close, however, oil can follow the path of the grooves to the combustion chamber, where it is consumed. One solution proposed to this problem is to provide two differently sized sets of spiral grooves with a small, undersized set of grooves to apply oil as a film on the valve stem and a large, oversized set of grooves to provide free flow of oil throughout the length of the valve. It is suggested that the final one or two turns of the small groove will eventually become clogged with carbon to prevent the flow of oil to the combustion chamber. This solution is, however, unsatisfactory because the amount of carbon buildup in the undersize grooves will vary over the life of the engine. Further, it is not apparent how oil would be prevented from migrating along the large set of grooves into the combustion chamber.

SUMMARY

The present invention provides a solution to the vexatious problem described above. According to the invention, a slitted tubular valve guide is provided with a substantially spiral groove along its entire length. At each point of intersection between the spiral groove and the slit, the ends of the groove segments immediately adjacent the slit are offset by an amount sufficient to create a discontinuity in the groove. The spiral groove is, therefore, divided into a number of inclined, decoupled groove segments incapable of flowing lubricating oil along their linear extent to the combustion chamber.

It has been discovered that superior lubrication of the valve stem is experienced even while the wasteful loss of lubricating oil is significantly reduced. It is believed that the reason for this performance is that providing discontinuities in a spiral groove divides the groove into one revolution groove segments that are inclined with respect to the normal cross section of the valve stem. This inclination is important in assuring an adequate movement of oil across the interface between the valve stem and guide from one groove to an adjacent groove. This is because valves not only reciprocate within the guide, but rotate as well. It is believed that the rotation of the valve, in combination with the inclined groove segments, provides adequate oil movement between the disconnected groove segments to properly lubricate the valve stem. This movement is necessary, because the discontinuities in the groove would otherwise prevent oil movement between groove segments. Excessive oil migration to the combustion chamber is, however, prevented.

In one aspect of the invention, therefore, a series of discontinuities, or dams, are spaced along a spiral groove in a valve guide liner to divide the groove into a number of isolated, inclined groove segments incapable of providing oil migration to the combustion chamber.

Another aspect of the invention, is an improved method for making a slit tubular valve guide. A series of inclined, parallel groove segments are formed on a piece of flat stock. The flat stock is rolled into an internally grooved cylinder of a proper diameter to essentially close the slit when fitted into a valve guide. The grooves segments are inclined and spaced so that, when the flat stock is rolled into a valve guide liner, the groove segments will form a spiral groove with the exception that the ends of the segments adjacent the tube slit are offset to provide discontinuities, or dams, in the spiral. Because the grooves are preformed on the flat stock, no knurling tool is required in the field to form the grooves in the liner after it is installed in the guide.

One advantage of the invention, therefore, is the provision of a valve guide liner that greatly reduces or eliminates the migration of oil to the combustion chamber of an internal combustion engine. Another advantage is that the lubricating properties of the liner are maintained even while oil waste is reduced. Yet another advantage is that the insert liner is fabricated in a manner that is simple and that additionally eliminates the need for an additional tool to install the guides in the field.

DESCRIPTION OF THE PREFERRED EMBODIMENT

Figure 1:
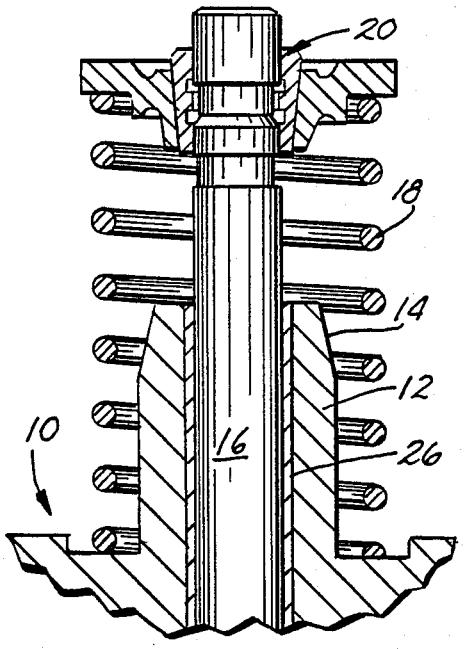
FIG. 1 is a side elevated view in section of a typical valve guide and valve stem in operating position.

Referring now to the drawings, and to FIG. 1 in particular, an overhead valve engine 10 has machined therein a valve guide 12 with an exposed shoulder portion indicated generally by the reference numeral 14 through which the valve stem 16 is passed during assembly. Ordinarily, the exposed shoulder 14 will be integrally cast with the remainder of the head and thereafter machined to proper dimensions. A valve spring 18 encircles exposed shoulder portion 14 of the valve guide assembly and the valve is conventionally retained with respect thereto by a pair of valve keepers 20. The valve stem 16 extends downwardly and terminates in a valve portion (not shown). A suitable seat (not shown) machined into the lower surface of the head 10. The valve portion opens into an engine combustion chamber (not shown). Valve spring 18 retains the valve in closed position with respect to the seat except when forced downwardly by a rocker arm (not shown) or the like in proper operational sequence.

Figure 2:
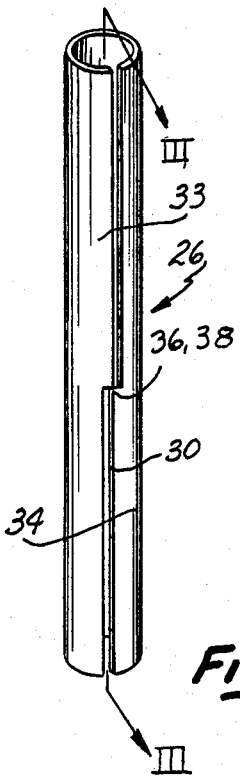
FIG. 2 is a perspective view of a tubular insert used in practicing the invention.
Figure 4:
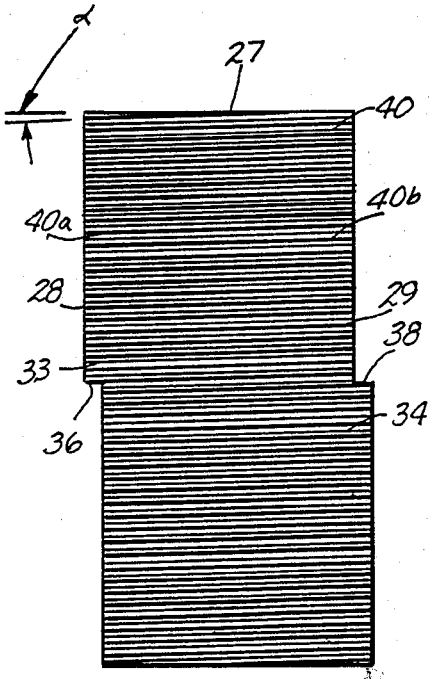
FIG. 4 is a front view of the flat stock before it is formed into a tubular insert.

A valve guide liner 26 is closely fitted within the opening in valve guide 12. Referring to FIGS. 2 and 4, the guide liner 26 is an elongated tubular member with a seam 30 extending the entire length thereof. Seam 30 is formed between a first edge portion 28 and a second edge portion 29 of the flat stock 27 from which the liner is formed. The dimensions of the flat stock 27 are selected such that after the guide liner is fitted into the valve guide 12, the seam 30 will be substantially continuous, i.e., closed.

A first finger member 33 is defined by first edge portion 28. A second finger member 34 is defined by second edge portion 29. The finger members 33, 34 have overlapping transverse edge portions 36, 38 to additionally inhibit oil flow along the seam 30. For further information on the general construction of such an insert and the method of inserting it into a valve guide, reference is made to U.S. Pat. No. 3,828,415 which is hereby incorporated herein by reference.

Figure 3:
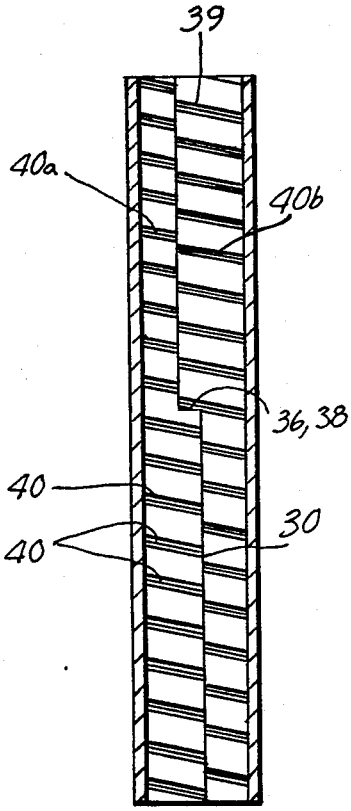
FIG. 3 is a sectional rear view of the front of a tubular insert taken along the line III—III in FIG. 2.

Referring to FIG. 3, the internal structure of guide liner 26 will be disclosed in detail. It can be seen that the seam 30 becomes substantially closed when the guide liner is fitted into a valve guide. A substantially spiral groove 39 extends the entire length of guide liner 26. Groove 39, however, is not continuous but is rather divided into a series of spiral groove segments 40. Each groove segment 40 begins and ends at seam 30. The division of spiral groove 39 into groove segments 40 occurs because the groove is discontinuous at seam 30. The discontinuity is created because a first end **40*a* of groove segment 40 is offset laterally, or upwardly as viewed in FIG. 3., from a second segment end 40*b***. In the disclosed embodiment the amount of groove lateral offset is approximately 0.03 inches. This lateral offset creates a dam to any lubricating oil that may be flowing linearly along the spiral groove. It can be seen therefore that oil will be prevented from flowing linearly from one groove segment to the other.

The division of the spiral groove into a series of groove segments results in such segments being inclined with respect to the normal cross section of the guide liner. This inclination is important to assuring proper lubrication of the valve stem because, as the valve stem rotates as well as reciprocates within the guide liner, oil is transferred from one groove segment to another across the face of the stem. This action assures adequate lubrication of the valve stem while preventing excessive oil migration to the combustion chamber below.

Referring to FIG. 4, guide liner 26 is constructed from a flat stock 27. Stock 27 is substantially rectangular in shape and is appropriately sized to close the seam 30 upon insertion into a valve guide. Finger portion members 33, 34 are seen as offset portions in the stock 27. It can be seen that spiral groove segments 40 are formed into stock 27 as a series of slightly inclined, parallel straight groove segments. The spacing of the groove segments and their angle of inclination are predetermined in relationship to the width of stock 27 so that, when the stock is formed into a guide liner, the groove segment ends **40*a*, 40*b*, are laterally offset as shown in FIG. 3**.

Figure 5:
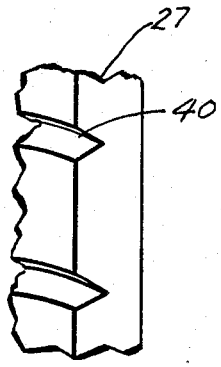
FIG. 5 is a segmented perspective view of the wall of the insert showing the grooves formed therein.

The preferred angle of inclination of the groove segments 40 to provide the desirable lubrication properties is one and one-half degrees with respect to the normal cross section of the guide liner. The preferred cross-sectional form of the groove segments is a triangular notch as seen in FIG. 5. This shape is desirable because it requires a lesser amount of force to form into the surface-hardened phosphor bronze flat stock 27. The groove segments may be formed by either a stamping or a rolling process. Because the groove segments are formed in flat stock before it is rolled into a liner, it would be possible to form the grooves in the stock prior to the surface hardening procedure.

The wall thickness of the flat stock 27 is preferably between 10 and 25 thousandths of an inch. Although the liner has been disclosed as constructed from a homogeneous material, it is equally applicable to a multiple layer guide liner such as disclosed in U.S. Pat. No. 4,103,662 assigned to the assignee of the present invention.

As previously explained, the dimensions of flat stock 27 are preselected to substantially close seam 30 when the liner is press-fitted into a valve guide. The thickness of stock 27 is additionally preselected so that the inside diameter of guide liner 26 will be no greater than the diameter of the valve stem. Subsequent to fitting the liner into the guide, whether as a guide rebuilding process or as a part of an engine manufacturing process, the final step in the procedure would be to finish the inside diameter of the liner to match that of the valve stem. This can be accomplished by passing a ball broach or a reamer through the liner, as is known in the art.

It is thus seen that the present invention comprehends an improved valve guide liner that reduces the amount of oil migration down the valve stem into the combustion chamber of the engine. The invention further comprehends the construction of such a liner by preforming the groove segments in the flat stock prior to forming into a liner. The groove segments are oriented so that the ends are offset when in the valve guide to provide the discontinuities in the spiral groove. Finally, the invention comprehends an improved method of making such a valve guide liner that eliminates the requirement for a knurling step subsequent to installation in the valve guide.

Changes and modifications in the specifically described embodiments can be carried out without departing from the scope of the invention which is intended to be limited only by the scope of the appended claims.

I claim:

1. A valve guide insert for lining and relining of a valve guide of an internal combustion engine, said engine including a valve having a stem axially reciprocating within said valve guide, and a source of lubricating oil external of said valve guide, said valve guide insert comprising:

a cylindrical sleeve having an outside surface adapted to be press-fitted within a valve guide and an inside surface adapted to receive a valve stem therethrough;

means defining a plurality of annular groove segments on said inside surface spaced along the entire length of said insert;

discontinuity means defining discontinuities between said groove segments at opposite ends thereof for preventing linear migration of engine oil between said groove segments each of said groove segments comprises one revolution around said inside surface; and transferring means for transferring oil laterally between groove segments, said transferring means comprising said groove segments being inclined with respect to the cross section of said insert such that said stem rotating within said insert will transfer oil across said inside surface between adjacent groove segments, said transferring means providing means for lubricating said stem by moving lubricating oil from said source axially along said insert.

2. The valve guide insert of claim 1, wherein said discontinuities means comprises discontinuities in the linear alignment of adjacent ones of said opposite ends.

3. The valve guide insert of claim 2, wherein the cylindrical sleeve has a thin wall.

4. The valve guide insert of claim 3, wherein said sleeve has a longitudinal seam along its entire length and said ends are located adjacent said seam.

5. The valve guide insert of claim 1, wherein said cylindrical sleeve is formed from phosphor bronze.

6. A valve guide insert for lining and relining a valve guide of an internal combustion engine said engine including a valve having a stem axially reciprocating within said valve guide, said valve guide insert comprising:

a thin-walled cylindrical sleeve formed from flat stock and having an outer surface adapted to be press-fitted within a valve guide and an inside surface adapted to contact the stem of said valve;

said sleeve having a first and second edge portion defining a longitudinal seam extending the length thereof;

multiple inclined annular groove segments formed in said inside surface, said groove segments having opposite ends thereof adjacent said seam; and means defining discontinuities which are located at all groove segment ends and disposed along said seam for preventing linear migration of oil between segments.

7. The valve guide insert of claim 6, wherein each said discontinuity comprises a lateral offset of approximately 0.03 inches between adjacent ones of said ends.

8. The valve guide insert of claim 6, wherein said first and second edge portions comprise two interengaging finger portions which abut each other defining a transverse portion in said longitudinal seam.

9. The valve guide insert of claim 6, wherein the cylindrical sleeve has a thin wall.

10. The valve guide insert of claim 9 wherein the groove segments are substantially parallel and individually-continuous.

11. The valve guide insert of claim 10, wherein the groove segments are at a pitch of approximately 1.5 degrees.

12. The valve guide insert of claim 10 wherein the groove segments are triangular-shaped troughs.

13. A method of lining/relining a valve guide of an internal combustion engine comprising the steps of:

(a) providing a substantially rectangular sheet of thin flat stock having a pair of opposite side edges spaced apart such that they will join to form a substantially seamless cylindrical sleeve when said stock is rolled about an axis parallel said side edges and installed in a valve guide;

(b) forming a series of substantially straight parallel and equally spaced apart groove segments in a surface of said flat stock and;

(c) rolling said flat stock into a cylindrical sleeve about said axis with the surface having the groove segments inside;

wherein, the separation between said groove segments and the orientation of said groove segments with respect to said axis are preselected with respect to the distance between said side edges so that the ends of adjacent groove segments are non-aligned when the flat stock is rolled into a sleeve and the sleeve is inserted into the valve guide, to prevent oil migration linearly between groove segments.

14. The method of claim 13 wherein said groove segments are at an angle of approximately 1.5 degrees from a plane perpendicular said axis.

15. The method of claim 13 further including the step (d) treating said flat stock to increase its surface hardness;

and wherein, step (b) is performed before step (d).

16. The method of claim 13 wherein said flat stock is phosphor bronze.

17. The method of claim 13 further including the steps of (d) inserting said sleeve into said valve guide by confining said sleeve to a dimension no greater than the diameter of said valve guide while axially moving the sleeve into the valve guide; and (e) finishing said sleeve inside surface to the diameter of the valve stem.

18. A valve guide insert for lining and relining of a valve guide of an internal combustion engine, said engine including a valve having a stem axially reciprocating within said valve guide, said valve guide insert comprising:

a thin metal stock which is substantially rectangular in shape and having opposite parallel top and bottom edges and opposite parallel side edges, said side edges spaced apart such that they will join together when said stock is rolled into a cylindrical sleeve and installed into a valve guide;

one of said side edges laterally offset at a top portion thereof defining a first outwardly extending finger portion;

the other one of said side edges laterally offset at a bottom portion thereof defining a second outwardly extending finger portion, said fingers having laterally aligned transverse edge portions that will engage each other when said stock is rolled into a cylindrical sleeve and installed into a valve guide; and means defining a plurality of substantially straight parallel groove segments on a face of said stock ending at said side edges, said groove segments spaced apart and oriented on said stock in relationship to said side edges and the distance said side edges are spaced apart such that each groove end of the segments will be nonaligned with all other groove ends when said stock is rolled into a sleeve and inserted in a valve guide with said laterally aligned transverse edge portions engaged.

19. The valve guide insert of claim 18 in which said stock is a cylindrical sleeve with said face on the inside.

20. The valve guide insert of claim 18 in which said stock is made from phosphor bronze.

* * * * *

UNITED STATES PATENT AND TRADEMARK OFFICE

CERTIFICATE OF CORRECTION

PATENT NO. : 4,768,479

DATED : September 6, 1988

INVENTOR(S) : James A. Kammeraad

It is certified that error appears in the above-identified patent and that said Letters Patent is hereby corrected as shown below:

Column 5, line 28:

The first occurrence of "discontinuities" should be --discontinuity--.

Signed and Sealed this

Twenty-third Day of May, 1989

*Attest:*

DONALD J. QUIGG

*Attesting Officer*

*Commissioner of Patents and Trademarks*